United States Patent [19]

Watanabe et al.

[11] Patent Number: 5,067,143

[45] Date of Patent: Nov. 19, 1991

[54] CURRENT DETECTING CIRCUIT FOR X-RAY TUBE

[75] Inventors: Kiyomi Watanabe; Tetsuya Matsumoto, both of Tokyo, Japan

[73] Assignee: Origin Electric Co., Ltd., Tokyo, Japan

[21] Appl. No.: 541,154

[22] Filed: Jun. 20, 1990

[30] Foreign Application Priority Data

Jun. 26, 1989 [JP] Japan ..... 1-163098
May 14, 1990 [JP] Japan ..... 2-123660

[51] Int. Cl.[5] ..... H05G 1/34
[52] U.S. Cl. ..... 378/110; 378/109
[58] Field of Search ..... 378/109, 110, 117; 361/89, 94

[56] References Cited

U.S. PATENT DOCUMENTS 3,963,931 6/1976 Shapiro ..... 378/98
4,670,893 6/1987 Tsuchiya ..... 378/110

OTHER PUBLICATIONS

Japanese Patent Application Laid-Open No. SHO 63-269068; Nov. 7, 1988.
Japanese Utility Model Application Laid-Open No. SHO 62-73499; May 11, 1987.
Japanese Utility Model Application Laid-Open No. SHO 62-86100; Jun. 1, 1987.
Japanese Utility Model Application Laid-Open No. SHO 62-109400; Jun. 13, 1987.

*Primary Examiner*—Edward P. Westin
*Assistant Examiner*—Don Wong
*Attorney, Agent, or Firm*—Darby & Darby

[57] ABSTRACT

A current detecting circuit for an X-ray tube is disclosed which includes a DC high voltage generating circuit connected across a filament and an anode of the X-ray tube and current detecting means connected in series in a filament circuit. The filament, which is at a high potential, receives a power from a secondary winding of an isolation transformer, which has sufficient dielectric strength to insulate a highest voltage generated by said DC high voltage generating circuit. A rectifier circuit is arranged to rectify a current fed from said secondary winding or another winding having same dielectric strength as that of said secondary winding, and said rectifier circuit supplies a power to a signal transmitting circuit. The signal transmitting circuit is energized, according to the current detected by said current detecting means, to transmit an output signal. The output signal is transmitted through electrically isolated transmission means to a signal receiving circuit, which is at a ground potential.

In case of an X-ray tube of double-filament type having a large focal spot filament and a small focal spot filament, switching means is provided to automatically change over a resistance of a current detecting resistor, in accordance with selection of the large focal filament and the small focal spot filament.

9 Claims, 6 Drawing Sheets

INV.
1
21
22
23
24
25
2
74
7
71
72
65
6
D
3
31
32
11
C1
D1
36
STAB. CKT
52
82
83
85
86
9
92
91
F/V
95
U1
OSC
U2
Q1
Q2
8
81

INV.
21
22
23
25
24
2
74
7
71
72
65
6
D
3
11
31
32
33
36
D1
C1
STAB. CKT
52
82
83
85
86
9
92
91
95
F/V
U1
Q1
OSC
U2
Q2
8
81
D

INV.
1
2
21
22
23
24
25
7
71
72
73
74
L
C
S
65
61
62
63
631
632
633
634
635
636
D
31
32
33
41
42
43
44
11
12
L
S
D1
36
442
444
STAB. CKT
52
82
83
85
86
9
92
91
95
F/V
U1
U2
Q1
Q2
OSC.
81
8
D

CURRENT DETECTING CIRCUIT FOR X-RAY TUBE

BACKGROUND OF THE INVENTION

1. Field of the Invention

The present invention relates to a current detecting circuit for an X-ray tube.

2. Description of the Related Art

Heretofore, a circuit as shown in FIG. 9 has been used as a high-voltage current detecting circuit for detecting a current of an X-ray tube. Referring to FIG. 9, a high-frequency inverter 1 is connected to a high-voltage transformer 2, which has secondary windings 22 and 23, which produce a high-frequency output at a higher voltage. The secondary windings 22 and 23 have equal numbers of turns to each other, and a center tap is grounded at a point 25.

The voltage across the secondary windings 22 and 23 is rectified by a high-voltage rectifier 4, which has a positive output terminal connected to an anode 74 of the X-ray tube 7 and a negative output terminal connected to one terminal 72 of a filament of said X-ray tube 7. An AC voltage source 11 is connected to an isolation transformer 3 having a primary winding 31 and a secondary winding 32. The secondary winding 32 is connected to filament terminals 71 and 72 of the X-ray tube 7. Current passing through the X-ray tube 7 can be measured and detected at any point of A, B, C and D. In case of the point A or B, it is required to provide a high voltage insulation for a detecting device or the like. In case of the point C, it is possible to detect the current by rectifying the current by a rectifier circuit, but in this case it is required to provide a high insulation for the detecting device or the like. In case of the point D, which is connected to the center tap, it is required to rectify the current by a rectifier circuit in order to detect the current. However, in this case a stray current may pass through the detecting circuit simultaneously with a current to be detected, because stray capacity is formed between the windings 22 and 23, causing a current for charging or discharging them. The stray current is so high that it is not negligible in the case where the high frequency inverter is employed.

Thus, it will be understood that the current detecting system heretofore proposed presents important problems in providing high insulation and high precision of measurement.

OBJECTS OF THE INVENTION

It is an object of the present invention to provide a current detecting circuit for an X-ray tube which solves the problems of insulation and precision of measurement.

It is another object of the present invention to provide a current detecting circuit for a double-filament type X-ray tube which can detect a current of the X-ray tube of this type, with high insulation and at a high precision.

SUMMARY OF THE INVENTION

In accordance with the present invention, there is provided a current detecting circuit for an X-ray tube which provides an insulation between a primary winding and a secondary winding of an isolation transformer for feeding a current to a filament of an X-ray tube, whereby the above-mentioned problems can be solved.

Thus, in accordance with the present invention, a power source for a high-voltage current detecting system is constituted by utilizing a dielectric strength of the isolation transformer itself. Further in accordance with the present invention, current detecting means is arranged to be changed over by switching means which is responsive to energization of one of secondary windings of the isolation transformers.

In the current detecting circuit for the X-ray tube of a double-filament type according to the present invention, the power circuit for supplying the power to the detecting system has a necessary and sufficient dielectric strength and the current detecting means is changed over to an optimum condition for a current of the X-ray tube depending on the selection of the filament to be excited.

DESCRIPTION OF THE PREFERRED EMBODIMENTS OF THE INVENTION

A description will be given to the preferred embodiments of the present invention, with reference to the drawings.

Figure 1:
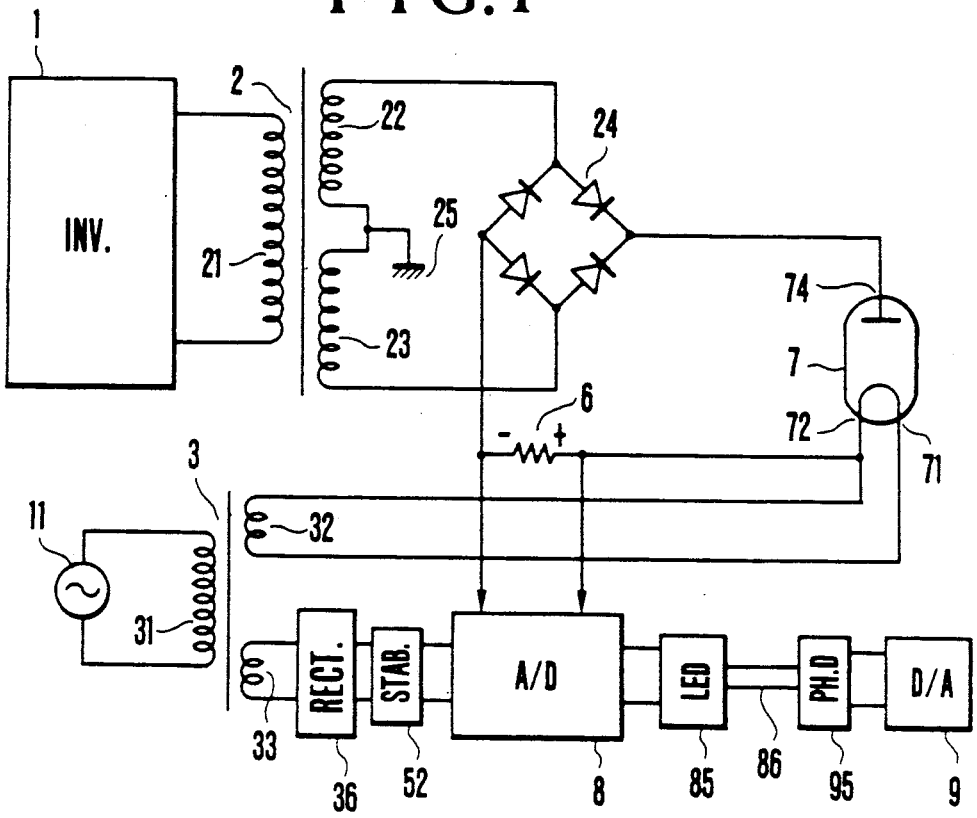
FIG. 1 illustrates an embodiment of the present invention.

FIG. 1 illustrates an embodiment of the present invention. Firstly, a description will be given to the construction shown in FIG. 1. A high-frequency inverter 1 is connected to a high-voltage transformer 2 having a primary winding 21 and secondary windings 22 and 23, and a high-frequency higher voltage output is produced across the secondary windings 22 and 23. The secondary windings 22 and 23 have numbers of turns, which are equal to each other, and these windings have a neutral point which is grounded at the point 25. Owing to grounding of the neutral point, the ground potential of an anode-filament voltage of the X-ray tube can be shared half-and-half to an anode and a filament of the X-ray tube.

The voltage across the secondary windings 22 and 23 is rectified by a high-voltage rectifier 24 consisting of a bridge circuit including four diodes. The positive output terminal of the rectifier 24 is connected to an anode 74 of the X-ray tube 7. The negative output terminal of said rectifier 24 is connected through a detecting resistor 6 to one of terminals 72 of the filament.

An AC power source 11 is connected to an isolation transformer 3 having a primary winding 31 and secondary windings 32 and 33. The secondary winding 32 of the transformer 3 is connected to the terminals 71 and 72 of the filament. The other secondary winding 33 of the isolation transformer produces an AC voltage, which is converted into a DC voltage by a rectifier circuit 36 and stabilized by a stabilizer circuit 52. The stabilized voltage is fed to a source terminal of an A/D converter 8. A current signal produced by the detecting resistor 6 is connected to an input terminal of said A/D converter 8. An output of the A/D converter 8 is converted into an optical signal by a LED 85. This optical signal is reconverted to an electric signal by a photodetector 95, with a required insulating distance being held by an optical fiber link 86, and it is converted into an analog voltage signal by a D/A converter 9. Thus, the electron current of the X-ray tube can be measured. The voltage stabilizing circuit 52 may be omitted in the case where the adjustable range of the filament voltage is relatively small.

Figure 2:
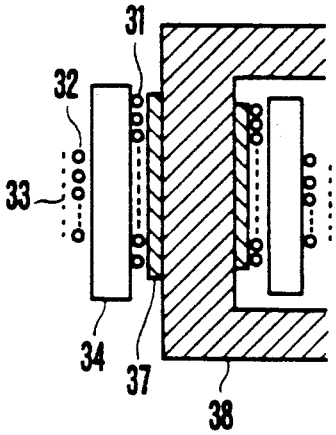
FIG. 2 illustrates an example of a transformer used in the embodiment shown in FIG. 1.

FIG. 2 is a sectional view of the transformer 3. The insulation structure between the primary and secondary windings of the transformer is utilized when the present invention is embodied. Referring to FIG. 2, the primary winding 31 is wound as a first layer around a core 38, with an insulating paper 37 being disposed therebetween, and an insulating bobbin 34 is disposed around an outer periphery of the primary winding. The secondary winding 32 is wound around the outside of the insulating bobbin 34 and the other secondary winding 33 is wound adjacent to the secondary winding 32. The transformer having such construction has substantial dielectric strength between the winding 31 and the winding 32 as well as between the winding 31 and the winding 33. Although there is not high dielectric strength between the windings 32 and 33, but in view of the fact that in practice no substantial potential difference exists between the winding 32 and the winding 33, it is not required to provide the high dielectric strength therebetween. It can be said that such construction is rather advantageous because the size of the transformer can be reduced because a special insulator is not required between them. This insulation construction of the transformer 3 may be modified to a construction in which the core 38 is positioned at the high potential and the secondary windings 32 and 33 are disposed inside of the bobbin while the primary winding 31 is disposed outside of the bobbin.

Figure 3:
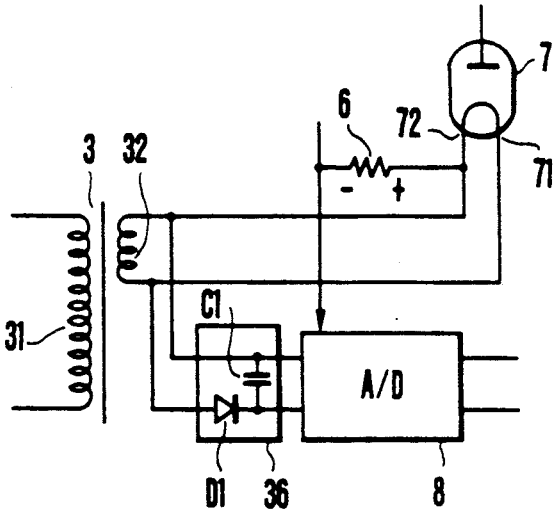
FIGS. 3–8 illustrate the other embodiments of the present invention, respectively.

FIG. 3 illustrates a modification of the present invention. According to this modification, the transformer 3 is so modified that the secondary winding 33 is omitted and the voltage of the secondary winding 32 is applied through a rectifier circuit 36 to the A/D converter 8 as a source voltage thereof. The rectifier circuit 36 consists of a diode D1 and a capacitor C1. If sufficient voltage is not obtained, it is possible to obtain the sufficient voltage by using a voltage doubler rectifier circuit or a voltage multiplying rectifier circuit, in place of the rectifier circuit 36. In this case, however, there is a limitation in the DC connecting relation between the detecting resistor 6 and the A/D converter 8. That is, it is required that a common terminal of the signal input terminals of the A/D converter 8 and one of source terminals therefor be connected in common.

Figure 4:
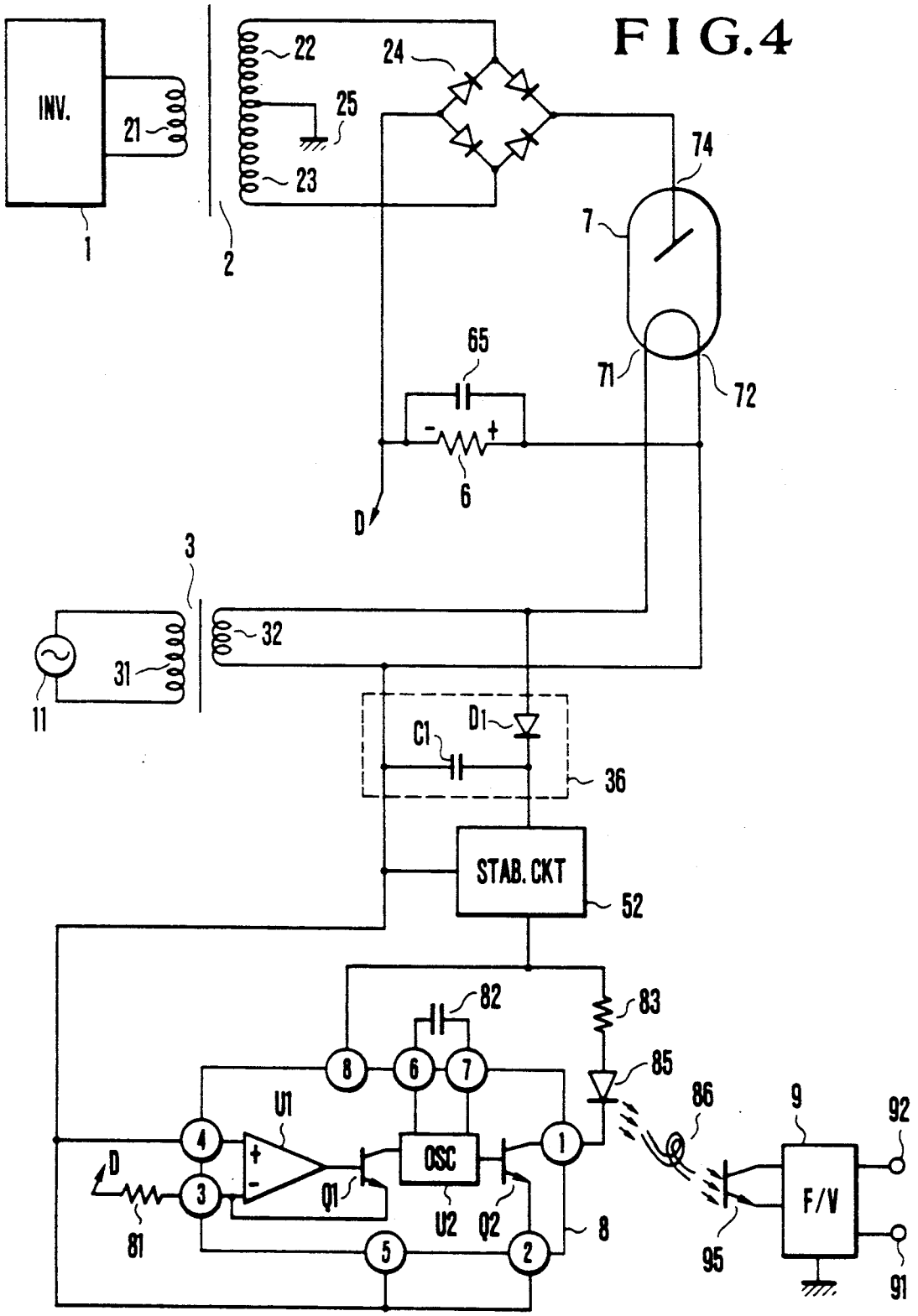

FIG. 4 illustrates an embodiment of the present invention which embodies the modified form shown in FIG. 3. In the embodiment shown in FIG. 4, the same elements as those shown in FIG. 3 are designated by the same reference numerals as in FIG. 3. In this embodiment, a capacitor 65 is connected in parallel with the current detecting resistor 6 which serves to detect the current of the X-ray tube 7. A V/F converter is used in place of the A/D converter 8 shown in FIG. 1 and a F/V converter is used in place of the D/A converter 9 shown in FIG. 1. The V/F converter 8 is constituted, for example, by a simple circuit using an integrated circuit AD 654 manufactured by ANALOG DEVICES CO. This circuit includes an inverting amplifier U1, so that it can be applied to a negative input of the detected voltage. In the embodiment shown in FIG. 4, the detected voltage is of negative polarity, it can be advantageously employed. When the voltage of the secondary winding of the transformer corresponding to the filament voltage is lower than 4 V, it is necessary to use the voltage doubler rectifier circuit as the rectifier 36. In this circuit, the rectifier circuit is constructed as a half-wave rectifier circuit, in order to make the co-junction point between the detecting resistor 6 and the filament terminal 72 to be common to the common wire (5) to (2) of the V/F converter 8. A series circuit of a LED 85 and a resistor 83 is connected across an output terminal (1) of the V/F converter 8 and a source terminal (8). A light emitted from the LED 85 is transmitted to the input of a photo-transistor 95 of the F/V converter 9, which is at a grounded potential, through an optical fiber link 86 which has an insulation distance sufficient to resist against a high potential of the filament of the X-ray tube 7. A capacitor 82 is connected across terminals (6) and (7) of the V/F converter 8 and it serves to set an oscillating frequency of an oscillator U2.

In operation, the current signal of the X-ray tube 7 which has been detected by the detecting resistor 6 is connected through a resistor 81 to an input terminal (3) of the V/F converter 8. An output of the V/F converter 8 is converted into an optical signal by the LED 85 and it is reconverted into an electric signal by the photo-transistor 95 which is disposed at a required insulating distance from the LED by the optical fiber link 86. Said electric signal is converted into an analog voltage signal by the F/V converter and thus a voltage in proportion to the detected current appears at output terminals 91 and 92. Thus the current of the X-ray tube 7 can be determined. In this circuit the voltage stabilizing circuit 52 may be omitted if the adjustable range of the filament voltage is small. The capacitor 65 connected in parallel with the detecting resistor 6 serves to smooth ripples which may occur in the current signal.

Figure 5:
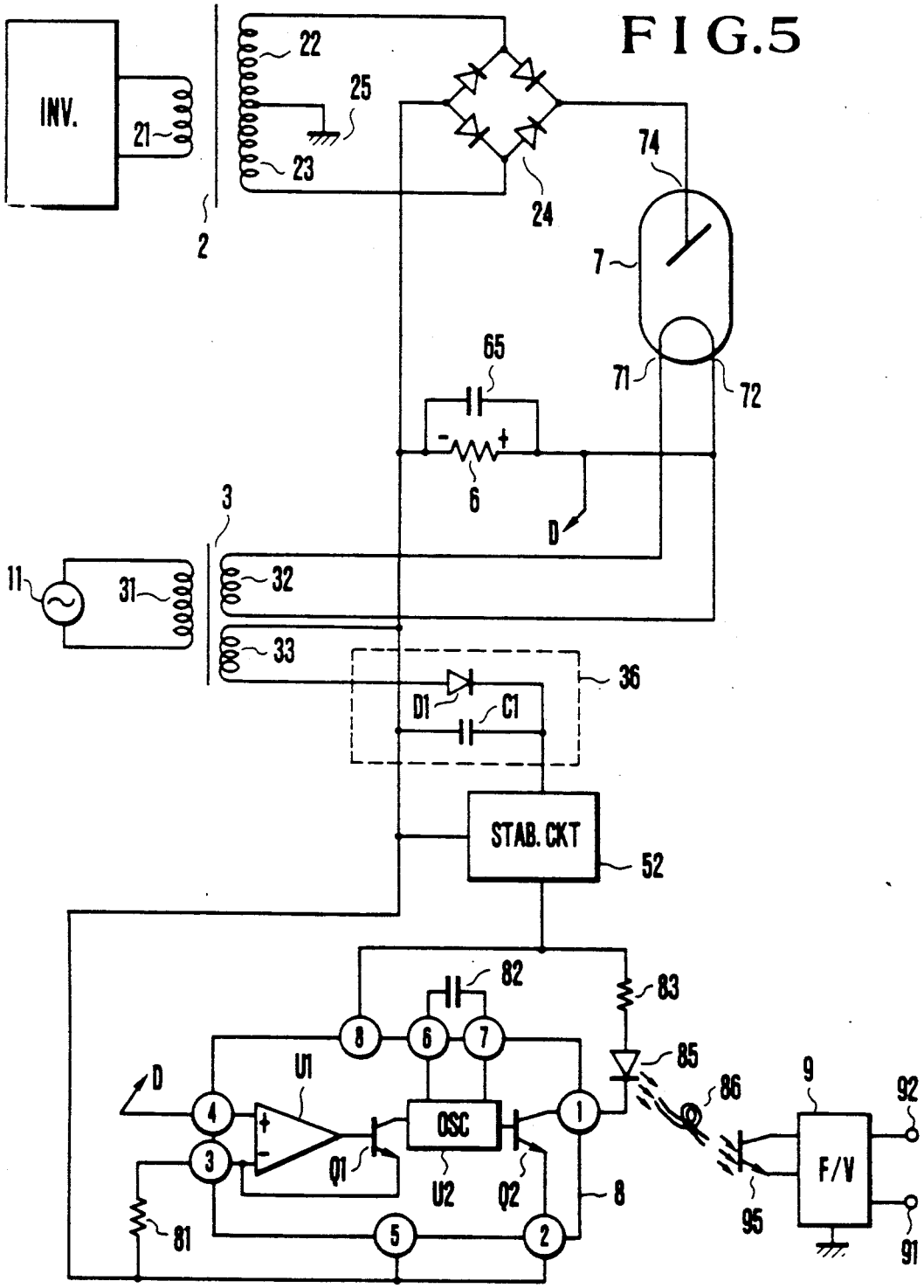

FIG. 5 illustrates another embodiment of the present invention. This embodiment shows more detailed construction than that shown in FIGS. 1 and 2. In FIG. 5, the same elements as those shown in FIGS. 1 and 2 are designated by the same reference numerals in FIGS. 1 and 2. In this embodiment, the detected voltage based on the current of the X-ray tube 7 is applied to an input terminal (4) of the V/F converter 8 with a positive polarity. An input terminal (3) of the V/F converter 8 is connected through a resistor 81 to a common potential.

Figure 6:
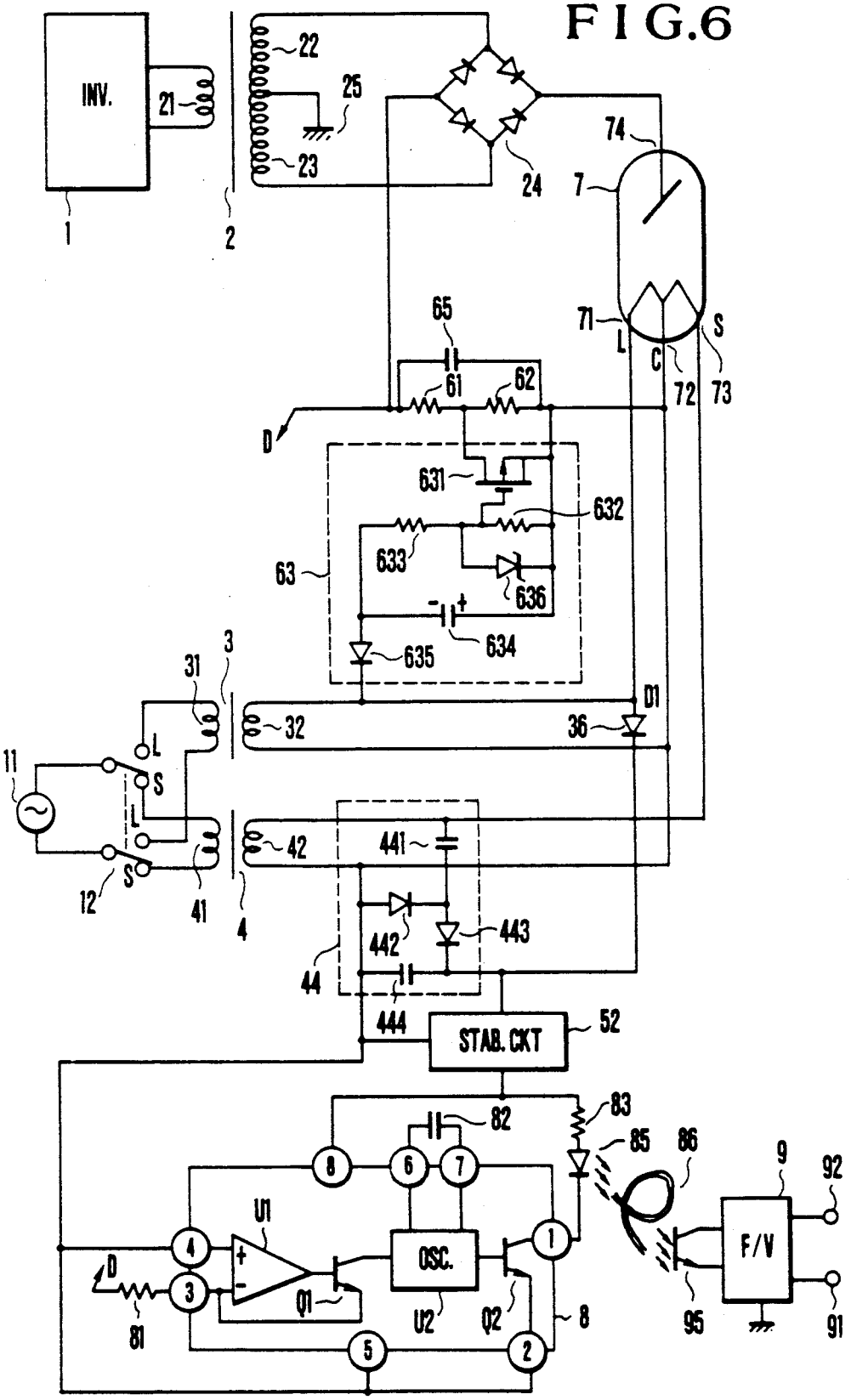

FIG. 6 illustrates a further embodiment of the present invention. In the embodiment shown in FIG. 6, a double-filament X-ray tube having a large focal spot filament for producing a large spot on a target and a small focal spot filament for producing a small spot on the target is used. This double-filament X-ray tube is arranged to provide a selection of sensitivity for a current detection by automatically changing over current detecting resistors in the path of the double-filament X-ray tube.

Firstly, the construction will be explained. A high-frequency inverter 1 is connected to a high voltage transformer 2 having a primary winding 21 and secondary windings 22 and 23, which produce a high frequency output at higher voltage. The secondary windings 22 and 23 have equal turns with each other and a neutral point is connected to ground at the point 25. Owing to grounding of the center tap, the ground potential of the anode-filament voltage of the X-ray tube 7 can be shared half-and-half to the anode and the filament of the X-ray tube.

The voltage across the both terminals of the secondary windings 22 and 23 is rectified by a high-voltage rectifier 24. The positive output terminal of the rectifier is connected to the anode 74 of the X-ray tube 7. The negative output terminal of the rectifier 24 is connected through detecting resistors 61 and 62 to a common terminal 72 of the double filament of the X-ray tube 7.

An AC power source 11 is connected through a filament selector switch 12 to primary windings 31 and 41 of isolation transformers 3 and 4, respectively. A secondary winding 32 of the isolation transformer 3 is connected to a terminal 71 and the common terminal 72 of the large focal spot filament. The secondary winding 32 is also connected to a switching circuit 63. A secondary winding 42 of the isolation transformer 4 is connected to a terminal 73 and the common terminal 72 of the small focal spot filament. The switching circuit 63 consists of a diode 635, a Zener diode 636, a capacitor 634, a resistor 632, a capacitor 633 and a P-channel FET 631. When a voltage is produced at the secondary winding 32 of the isolation transformer 3, a voltage is developed across the capacitor 634 at a polarity, as shown in FIG. 6. The voltage which is negative to the high common potential is divided by the resistor 633 and the resistor 632 and a negative bias voltage is applied to the gate of the FET. The FET 631 is of P-channel type and, therefore, it is turned ON by the negative bias voltage. The Zenor diode 636 serves to protect the gate from being subjected to an excessive voltage. When the FET in the switching circuit 63 is turned ON, the detecting resistor 62 is short-circuited.

The secondary windings 32 and 42 of the isolation transformers 3 an 4 are connected to the rectifier circuits 36 and 44, respectively, and the voltages thereof are converted into DC voltages, respectively. The DC outputs thereof are connected in parallel and fed through a stabilizing circuit 52 to a source terminal (8) and a common terminal (5) of the V/F converter 8. The V/F converter is constituted by a circuit which includes, for example, AD 654 manufactured by ANALOG DEVICES CO. This circuit includes an inverting amplifier in its input stage, which can deal with a negative detected current input. In this embodiment the detected voltage is of negative polarity, so that this circuit can be advantageously employed. The rectifier circuit 36 is a half-wave rectifier and the rectifier circuit 44 is a voltage doubler rectifier circuit consisting of a capacitor 441, diodes 442 and 443 and a capacitor 444. The capacitor 444 is commonly used in these two rectifier circuits 36 and 44. If the voltage of the secondary winding of the transformer for filament is higher than about 4 V, it is not necessary to use the voltage doubler arrangement, and only the half wave rectifier circuit is satisfactorily used.

The current signal of the X-ray tube 7 detected by the above-mentioned detecting resistors 61 and 62 is fed to the input terminal (4) of the V/F converter 8. The output of the V/F converter 8 is converted into an optical signal by the LED 85 and reconverted into an electric signal by the photo-transistor 95, which is disposed at a required insulating distance from the LED 85 by the optical fiber link 86. The electric signal thus produced is converted into an analog voltage signal by the F/V converter 9. Thus the current of the X-ray tube 7 can be determined. The voltage stabilizing circuit may be omitted if it is unnecessary to widely adjust the filament voltage.

In the circuit as constructed above, when the switch 12 is turned "ON" to the large spot side L and the AC power source 11 is applied to the primary winding 31 of the isolation transformer 3, only the large focal spot filament 71 of the X-ray tube is heated, so that the current passes through the large focal spot filament. At this time, the filament voltage is subjected to the half wave rectification by the diode 635, and the capacitor 634 is charged to the polarity as shown in the drawing. The negative voltage is divided by the resistor 632 and the resistor 633, so that a proper voltage is applied to the gate of the FET 631. The resistor 632 has several hundred KΩ to several MΩ and no pulsation occurs at the capacitor 634. Owing to this gate voltage, the FET 631 is turned ON and the resistor 62 is short-circuited. Accordingly, only the detecting resistor 61 contributes to the detecting function of the current of the X-ray tube. Actually, the current is enumerated as 20 mA–200 mA, and if it is assumed that the resistance of the resistor 61 is 20Ω, the detected voltage, which corresponds to the product of the current and the resistance, is enumerated as 0.4–4 V.

When the switch 12 is turned ON to the small focal spot side S and the isolation transformer 4 is actuated, only the small focal spot filament 73 of the X-ray tube 7 is heated, so that the current of the X-ray tube passes through the filament for the small focal spot. In this case, the voltage charged in the capacitor 634 discharges until the gate voltage becomes zero. The switching circuit 63 is turned OFF and the detecting resistor 62 is connected in the detecting circuit. Accordingly, the sum of the resistances of the detecting resistors 61 and 62, 200Ω, contributes to the detecting function of the electron current of the X-ray tube. In this case, the current is enumerated as 0.5 mA–20 mA, and if it is assumed that the resistance of the detecting resistor 61 is 20Ω and the resistance of the resistor 62 is 180Ω, the detecting voltage of 0.10 V–4.0 V will be produced. Thus, the detecting sensitivity of the X-ray tube current is automatically selected, depending upon whether the large focal spot filament or the small focal spot filament is excited. By selecting the excitation for the filament of the X-ray tube as described above, the switching circuit 63 is automatically actuated accordingly, so that the resistance for detecting the current of the X-ray tube is selected to an optimum value. The circuit of the detecting resistors 61 and 62 is at a high voltage potential, but the function of selecting the resistance is automatically effected, so that it is safe, without requiring any special insulating means therefor. The windings 32 and 42 for feeding the power for the filament have high dielectric strength, and this dielectric strength also contributes to provide the dielectric strength for the switching circuit 63, the V/F converter 8 and the like.

Figure 7:
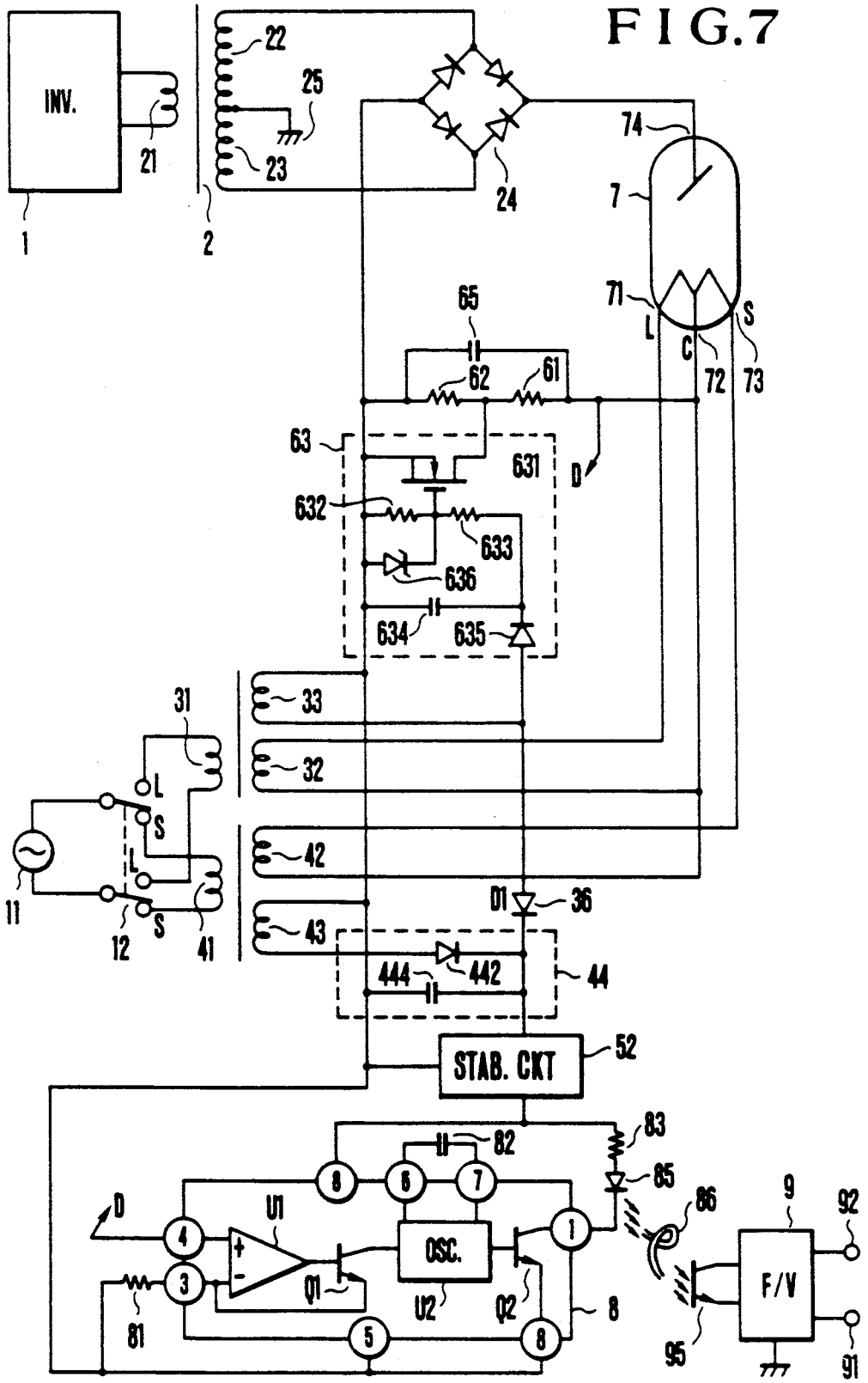

FIG. 7 illustrates another embodiment of the present invention. According to this embodiment, a double filament X-ray tube similar to that shown in FIG. 6 is used and current detecting resistors are arranged to be automatically changed over. A difference of this embodiment from that shown in FIG. 6 resides in the provision of an additional winding 33, which serves to feed a voltage to a rectifier circuit 36. The isolation transformer 3 in this embodiment has same construction as that shown in FIG. 2, and the isolation transformer 4 also has same construction. Therefore, the detailed description of these isolation transformers is omitted. In this embodiment, the same function can be achieved by feeding the power to the switching circuit 63 from either of the secondary winding 32 of the isolation transformer 3 or the secondary winding 42 of the isolation transformer 4. By particularly providing the winding 33, the FET 631 can be designed as a N-channel device and can be operated in opposite polarity to that in the embodiment as shown in FIG. 6.

Figure 8:
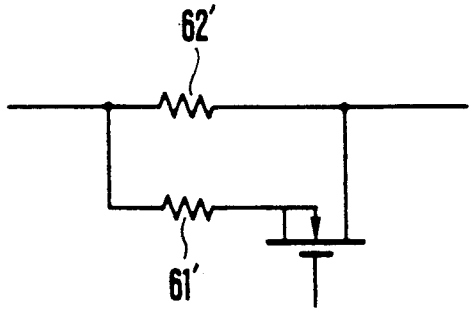
Figure 9:
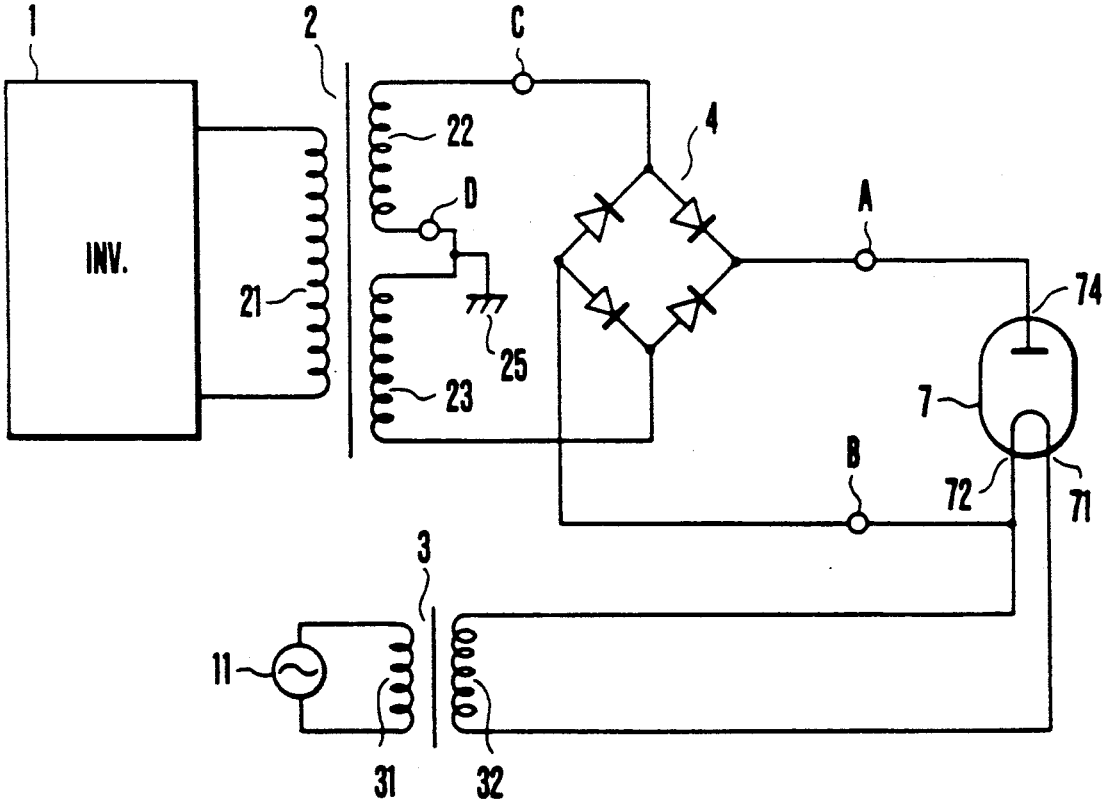
FIG. 9 illustrates an example of an X-ray device according to the prior art.

Although the embodiments of FIGS. 6 and 7 are shown as employing the FET in the switching circuit 63, other switching means such as bipolar transistor, relay or the like can be employed in the switching circuit. A changing-over signal for the switching circuit 63 may be fed from either of the isolation transformer 3 or 4, with a satisfactory result according to the present invention. Referring to the current detecting resistors 61 and 62, they are not limited to the series arrangement as shown in FIGS. 6 and 7 but they may be connected in parallel arrangement as shown in FIG. 8, with same effect. In case where it is not necessary to provide the sensitivity selection in the double-filament X-ray tube, the switching circuit 63 may be omitted.

The AC power source 11 for feeding the power to the filament is not limited to the commercial AC power source, and a high-frequency inverter may be employed in place thereof.

Referring to the light signal transmitting system, it is noted that the signal transmission by means of the V/F converter and F/V converter system and the optical pulse and optical fiber system, as described in the illustrated embodiments, produce little noise and little error. However, an analog system in which a signal is transmitted in the form of intensity of light can be applied to the present invention. As an electrically isolated signal transmitting system, an electro-magnetic means may be adopted in place of the optical means.

As hereinabove explained, the present invention provides a current detecting circuit for an X-ray tube which can detect an X-ray tube current, with a simple construction. A connecting circuit of the current detecting means is positioned at a cathode side of the X-ray tube, so that a charging and discharging current to and from a stray capacity is not involved in the current through the current detecting means, whereby the precision of detection is improved. Moreover, the circuit according to the present invention does not require any special means in connection with supplying and insulating a power to a transmitting circuit which handles a detecting signal, so that it is safe and economical. In case of a double-filament type X-ray tube including a large focal spot filament and a small focal spot filament, an optimum value of the current detecting means relative to a current of either filament can be automatically selected so that a ratio of a detecting signal and a noise can be improved. A special insulating means is not required for this purpose and, consequently, safety and economy are further improved.

What is claimed is:

1. A detecting circuit for detecting a current of an X-ray tube, comprising:

a DC voltage generating circuit for generating and supplying a direct current voltage across a filament and an anode of the X-ray tube;

current detecting means connected in series between a filament terminal of said X-ray tube and a terminal of said DC voltage generating circuit for detecting current passing through said X-ray tube;

an isolation transformer having a primary winding, a secondary winding for supplying a power for the filament, an additional secondary winding disposed adjacent to said secondary winding, and an insulating means disposed between said primary winding and both of said secondary and additional secondary windings, said insulating means having a sufficient dielectric strength to insulate with respect to a voltage which is the highest produced by said DC voltage generating circuit;

a rectifier circuit for rectifying a current from said additional secondary winding of said isolation transformer;

a signal transmitting circuit arranged to be powered from said rectifier circuit, said transmitting circuit being responsive to said current detecting means for transmitting an output signal;

a signal receiving circuit for receiving the output signal from said signal transmitting circuit, said signal receiving circuit being held at a ground potential; and electrically isolated transmission means for transmitting the signal from said signal transmitting circuit to said signal receiving circuit.

2. A detecting circuit for detecting a current of an X-ray tube, comprising:

a DC voltage generating circuit for generating and supplying a direct current voltage across a filament and an anode of the X-ray tube;

current detecting means connected in series between a filament terminal of said X-ray tube and a terminal of said DC voltage generating circuit for detecting current passing through said X-ray tube;

an isolation transformer having a primary winding and a secondary winding for supplying a power for the filament, said isolation transformer also having an insulation means between said primary and secondary windings that has a sufficient dielectric strength to insulate with respect to a voltage which is the highest produced by said DC voltage generating circuit;

a rectifier circuit for rectifying a current fed from said secondary winding;

a signal transmitting circuit arranged to be powered from said rectifier circuit, said transmitting circuit being responsive to said current decting means for transmitting an output signal;

a signal receiving circuit for receiving the output signal from said signal transmitting circuit, said signal receiving circuit being held at a ground potential; and electrically isolated transmission means for transmitting the signal from said signal transmitting circuit to said signal receiving circuit.

3. A current detecting circuit for an X-ray tube of a double-filament type having an anode, a first filament terminal, a second filament terminal and a common filament terminal, comprising:

a DC voltage generating circuit for generating and supplying a direct current voltage across said anode and said common filament terminal;

current detecting means connected in series between said common filament terminal and a terminal of said DC voltage generating circuit for detecting current passing through said X-ray tube;

a first isolation transformer having a primary winding and a secondary winding for supplying a power across the common filament terminal and the first filament terminal, said first isolation transformer also having an insulation means between said primary and secondary windings that has a sufficient dielectric strength to insulate with respect to a voltage which is the highest generated by said DC voltage generating circuit;

a second isolation transformer having a primary winding and a secondary winding for supplying a power across the common filament terminal and the second filament terminal of said X-ray tube, said second isolation transformer having insulation means between said primary winding of said second isolation transformer and said secondary winding of the second isolation transformer that has sufficient dielectric strength to insulate with respect to the highest voltage generated by said DC voltage generating circuit;

a first rectifier circuit for rectifying a current from the secondary winding of said first isolation transformer;

a second rectifier circuit for rectifying a current from the secondary winding of said second isolation transformer;

a signal transmitting circuit receiving power from each of the rectifier circuits and being being responsive to said current detecting means for transmitting an output signal;

a signal receiving circuit for receiving the output signal from said signal transmitting circuit, said signal receiving circuit being held at a ground potential; and electrically isolated transmission means for transmitting the signal from said signal transmitting circuit to said signal receiving circuit.

4. A current detecting circuit for detecting a current of an X-ray tube, according to claim 3, further comprising:

switching means connected and responsive to either one of the secondary windings of said first and second isolation transformers, to energize either one of said detecting means.

5. A current detecting circuit for an X-ray tube of a double-filament type having an anode, a first filament terminal, a second filament terminal and a common filament terminal, comprising:

a DC voltage generating circuit for generating and supplying a direct current voltage across said common filament terminal and the anode;

current detecting means connected in series between said common filament terminal and a terminal of said DC voltage generating circuit for detecting current passing through said X-ray tube;

a first isolation transformer having a primary winding and a secondary winding for supplying a power across the first filament terminal and the common filament terminal of said X-ray tube, said first isolation transformer also having an insulation means between said primary and secondary windings that has a sufficient dielectric strength to insulate with respect to a voltage which is the highest generated by said DC voltage generating circuit, said first isolation transformer including an additional winding disposed adjacent to said secondary winding;

a second isolation transformer having a primary winding and a secondary winding for supplying a power across the common filament terminal and the second filament terminal of said X-ray tube, said second isolation transformer having insulation means between said primary winding of said second isolation transformer and said secondary winding of the second isolation transformer that has sufficient dielectric strength to insulate with respect to the highest voltage generated by said DC voltage generating circuit, said second isolation transformer including an additional winding disposed adjacent to said secondary winding of said secondary isolation transformer;

a first rectifier circuit for rectifying a current from the additional winding of said first isolation transformer;

a second rectifier circuit for rectifying a current from the additional winding of said second isolation transformer;

a signal transmitting circuit receiving power from each of the rectifier circuits and being responsive to input from said current detecting means for transmitting an output signal;

a signal receiving circuit for receiving the output signal from said signal transmitting circuit, said signal receiving circuit being held at a ground potential; and electrically isolated transmission means for transmitting the signal from said signal transmitting circuit to said signal receiving circuit.

6. A current detecting circuit for an X-ray tube, according to claim 5, further comprising:

switching means connected and responsive to either one of the secondary windings of said first and second isolation transformers, to energize said detecting means.

7. A current detecting circuit for an X-ray tube, according to claim 5, further comprising:

switching means connected and responsive to either one of the additional windings of said first and second isolation transformers, to energize said detecting means.

8. A detecting circuit for detecting a current of an X-ray tube, comprising:

a DC voltage generating circuit for generating and supplying a direct current voltage across a filament and an anode of the X-ray tube;

an isolation transformer having a primary winding and a secondary winding for feeding a current to the filament, said isolation transformer having an insulation between said primary winding and secondary winding;

current detecting means responsive to energization of said secondary winding for detecting a current passing through the X-ray tube;

a rectifier for rectifying a current from said secondary winding; and means responsive to said rectified current for operating and being responsive to the detected current for transmitting a signal indicative of the current detected.

9. A detecting circuit as in claim 8, wherein said secondary winding includes a first secondary winding and a second secondary winding, said current detecting means being responsive to energization of one of said first and second secondary windings for detecting said current passing through the X-ray tube, said rectifier being for rectifying a current from one of said first and second secondary windings.

* * * * *